US011773620B2

(12) United States Patent
Huang et al.

(10) Patent No.: US 11,773,620 B2
(45) Date of Patent: Oct. 3, 2023

(54) AUXILIARY LOCK WITH REINFORCEMENT STRUCTURE

(71) Applicant: TAIWAN FU HSING INDUSTRIAL CO., LTD., Kaohsiung (TW)

(72) Inventors: Chao-Ming Huang, Kaohsiung (TW); Jun-Kai Ko, Kaohsiung (TW)

(73) Assignee: Taiwan Fu Hsing Industrial Co., Ltd., Kaohsiung (TW)

( * ) Notice: Subject to any disclaimer, the term of this patent is extended or adjusted under 35 U.S.C. 154(b) by 0 days.

(21) Appl. No.: 17/678,391

(22) Filed: Feb. 23, 2022

(65) Prior Publication Data

US 2022/0178166 A1 Jun. 9, 2022

Related U.S. Application Data

(63) Continuation of application No. 16/528,850, filed on Aug. 1, 2019, now Pat. No. 11,299,910.

(30) Foreign Application Priority Data

Jan. 27, 2022 (TW) ..... 111201190

(51) Int. Cl.
*E05B 9/04* (2006.01)
*E05B 17/20* (2006.01)
*E05C 9/02* (2006.01)

(52) U.S. Cl.
CPC ..... *E05B 17/2084* (2013.01); *E05B 9/04* (2013.01); *E05C 9/026* (2013.01)

(58) Field of Classification Search
CPC ..... E05B 15/00; E05B 15/10; E05B 17/2084; E05B 9/04; E05B 9/026
USPC ..... 70/208, 416, 417, 134, 370
See application file for complete search history.

(56) References Cited

U.S. PATENT DOCUMENTS 3,713,683 A * 1/1973 Neary ..... E05B 63/0017 292/351
4,047,408 A * 9/1977 Johns ..... E05B 63/0017 70/149
4,073,172 A * 2/1978 Schlage ..... E05B 17/2084 70/370
4,338,804 A * 7/1982 Solovieff ..... E05B 15/1614 70/452
4,489,576 A * 12/1984 Mullich ..... E05B 63/06 292/DIG. 60
4,593,546 A * 6/1986 Allen ..... E05B 63/0017 70/370
5,057,975 A * 10/1991 Evigan ..... E05B 17/10 362/100

(Continued)

*Primary Examiner* — Suzanne L Barrett
(74) *Attorney, Agent, or Firm* — Rosenberg, Klein & Lee

(57) ABSTRACT

An auxiliary lock includes an inside housing mounted to a lock cylinder and a first flange extends axially from one of two ends of the inside housing. A mounting plate is mounted to the lock cylinder and contacts the inside housing. The mounting plate includes a second flange which is mounted to outside of the first flange of the inside housing. The lock cylinder is protected and reinforced in the radial direction by the overlapped first and second flanges. When the inside housing is hit, the inside housing does not expand outward to be pried up. The reinforcement structure is made by way of pressing to use less material and to reduce the manufacturing cost.

19 Claims, 8 Drawing Sheets

(56) References Cited

U.S. PATENT DOCUMENTS 5,216,910 A * 6/1993 Lin ..... E05B 15/1614 70/370
5,540,070 A * 7/1996 Adelmeyer ..... E05B 63/0056 70/462
5,722,273 A * 3/1998 Lin ..... E05B 55/005 292/147
5,761,937 A * 6/1998 Adelmeyer ..... E05B 55/005 292/DIG. 60
5,881,590 A * 3/1999 Small ..... E05B 63/0017 70/451
5,906,125 A * 5/1999 Shen ..... E05B 17/0058 70/451
6,230,528 B1 * 5/2001 Don ..... E05B 15/02 70/451
6,698,260 B2 * 3/2004 Su ..... E05B 15/02 292/357
6,840,070 B1 * 1/2005 Huang ..... E05B 3/06 70/451
7,389,660 B2 * 6/2008 Ebling ..... E05B 15/02 70/451
7,596,975 B1 * 10/2009 Yuan ..... E05B 63/0017 70/451
11,299,910 B2 * 4/2022 Huang ..... E05B 63/0017
2002/0096893 A1 * 7/2002 Wu ..... E05B 15/0053 292/357
2002/0108408 A1 * 8/2002 Beatty ..... E05B 9/08 70/370
2002/0108409 A1 * 8/2002 Beatty ..... E05B 9/082 70/370
2003/0041633 A1 * 3/2003 Britz ..... E05B 17/2084 70/370
2006/0179904 A1 * 8/2006 Shen ..... E05B 63/0004 70/370
2008/0121002 A1 * 5/2008 Sun ..... E05B 17/2084 70/124
2014/0144193 A1 * 5/2014 Lahiji ..... B21D 22/20 72/347
2016/0053512 A1 * 2/2016 Lahiji ..... E05B 15/00 70/417

* cited by examiner

AUXILIARY LOCK WITH REINFORCEMENT STRUCTURE

BACKGROUND OF THE INVENTION

1. Fields of the Invention

The present invention relates to an auxiliary lock, and more particularly, to an auxiliary lock with a reinforcement structure to protect the inside housing from being deformed by impact.

2. Descriptions of Related Art

Locks are usually installed to an object such as a door so as to have safety feature. The lock is locked and unlocked by using a correct key. Generally, a lock cylinder is equipped in the lock and includes a keyhole which faces outside of the door, and a turn piece is installed to the lock and located in the room. The users may turn the turn piece of lock or unlock the lock from inside of the room.

However, the unauthorized person may try to unlock the lock by damaging the outside housing and picking the lock cylinder out so that the lock fails to lock the door. In other words, by hitting the outside housing and picking the lock cylinder is able to fail the lock regardless of sophisticate structure of the lock. It is obvious that the lock needs a reinforcement structure to prevent the outside housing and lock cylinder from being damaged.

Therefore, another auxiliary lock is provided, which provides a reinforcement housing to outside of the lock cylinder. The s reinforcement housing is made of zinc or aluminum alloy die casting. Although it has a very high structural strength, it requires a lot of material, and the processes of making it is complicated, so that the retail price is high and difficult for consumers to accept.

The auxiliary lock usually includes an outside housing to accommodate the lock cylinder, and the outside housing includes threaded holes. Bolts extend through the mounting plate and are threadedly connected to the threaded holes to assemble the outside housing. However, there is no integrated fixation between the outside housing and the lock cylinder, resulting in less stability of the whole auxiliary lock. In addition, the outside housing can only be applied to a fixed door bore, so its applicability is also extremely limited.

The present invention intends to provide an auxiliary lock with a reinforcement structure to eliminate the shortcomings mentioned above.

SUMMARY OF THE INVENTION

The present invention relates to an auxiliary lock and comprises an inside housing which is a tubular housing and mounted to a lock cylinder in the radial direction of the inside housing. A first flange extends axially from one of two ends of the inside housing. A mounting plate is mounted to the lock cylinder in the axial direction of the lock cylinder and contacts the inside housing. The mounting plate includes a second flange extending axially therefrom, and the second flange is mounted to the outside of the first flange of the inside housing.

Preferably, the second flange is mounted to the outside of the first flange of the inside housing by way of pressing.

Preferably, the second flange includes a bent portion which is formed by bending inward the distal end of the second flange. A space is formed between the bent portion and the second flange. The first flange of the inside housing is located in the space. The bent portion is mounted to the outside of the first flange of the inside housing.

Preferably, the mounting plate includes an annular face extending therefrom and opposite to the inside housing. An end face is formed to the distal end of the annular face.

Preferably, the end face includes a protrusion extending from the inside thereof which faces the lock cylinder. When the mounting plate is mounted to the lock cylinder, the protrusion contacts the lock cylinder in the axial direction of the lock cylinder.

Preferably, the end face of the mounting plate includes at least one guide slot which includes a first hole and a second hole which communicates with the first hole. The diameter of the first hole is larger than that of the second hole, Preferably, the auxiliary lock further includes a housing ring that includes a contact face and a central hole. The contact face is located corresponding to the annular face. The central hole is located corresponding to the end face. At least one extension extends axially from the housing ring and opposite to the mounting plate. The contact face includes at least one pin which is located corresponding to the at least one guide slot. The at least one pin includes a shank which has a contact portion formed to the first end of the shank. The diameter of the shank is sized corresponding to the second hole. The diameter of the contact portion is sized corresponding to the first hole.

Preferably, the contact face includes at least one assembly hole, and the at least one pin is engaged with the at least one assembly hole.

Preferably, the at least one assembly hole communicates with an inclined hole which is located opposite to the contact face of the housing ring. The diameter of the inclined hole increases toward the direction opposite to the contact face. The shank includes an engaging portion and a positioning portion respectively formed to the second end thereof. The engaging portion is located corresponding to the least one assembly hole. The positioning portion is located corresponding to the inclined hole.

Preferably, the lock cylinder includes a first fixing hole. The end face of the mounting plate includes an aperture located corresponding to the first fixing hole. A locking member extends through the aperture from the outside of the end face and is connected to the first fixing hole.

Preferably, the locking member includes a threaded section and a head. The threaded section is threadedly connected to the first fixing hole. The diameter of the head is larger than that of the aperture. When the threaded section is threadedly connected to the first fixing hole, the head contacts the end face.

Preferably, an outside housing is mounted to the inside housing.

Preferably, the lock cylinder includes a lip extending radially therefrom. The outside housing includes a concaved surface located corresponding to the lip.

Preferably, the inside housing includes a through hole located corresponding to the lock cylinder. The outside housing includes a tubular portion extending from one end opposite to the inside housing and toward the inside housing. The tubular portion has a path defined centrally therethrough. The lock cylinder extends through the path. The outer periphery of the tubular portion contacts the inner periphery of the through hole.

Preferably, the tubular portion of the outside housing is made by way of pressing.

Preferably, the decoration cover is mounted to the outside housing.

Preferably, the inside housing is a tapered and tubular housing.

Alternatively, the present invention also provides an auxiliary lock that comprises an inside housing which is a tapered and tubular housing and includes a first end and a second end which is larger than the first end of the inside housing. A first flange extends axially from the second end of the inside housing. A mounting plate is mounted to the lock cylinder in the axial direction of the mounting plate and contacts the inside housing. The mounting plate includes a second flange extending axially therefrom. The second flange is mounted to the outside of the first flange of the inside housing.

Preferably, the second flange is mounted to the outside of the first flange of the inside housing by way of pressing.

The advantages of the present invention are that the lock cylinder is protected and reinforced in the radial direction by the overlapped first and second flanges. When the inside housing is hit, the inside housing does not expand outward to be pried up. The reinforcement structure is made by way of pressing to use less material and to reduce the manufacturing cost.

The protruded end face of the mounting plate is adapted to be installed to a door with small hole. When the door includes a large hole, the present invention is able to be installed to the door by using the housing ring. The mounting plate includes the guide slot, and the housing ring includes the pin which extends through the guide slot, and the housing ring is rotated to assemble the housing ring to the mounting plate without using any tool. The assembling steps are easy and the applicability of the auxiliary lock is optimized.

The lock cylinder includes a fixing hole and the end face of the mounting plate includes an aperture so that locking member extends through the aperture and is threadedly connected to the fixing hole to securely connect the lock cylinder to the mounting plate so as to form a one-piece unit with the inside housing to reinforce the strength of the auxiliary lock and to position the lock cylinder. When replacing the lock cylinder, simply by removing the locking member from the fixing hole to replace the lock cylinder.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
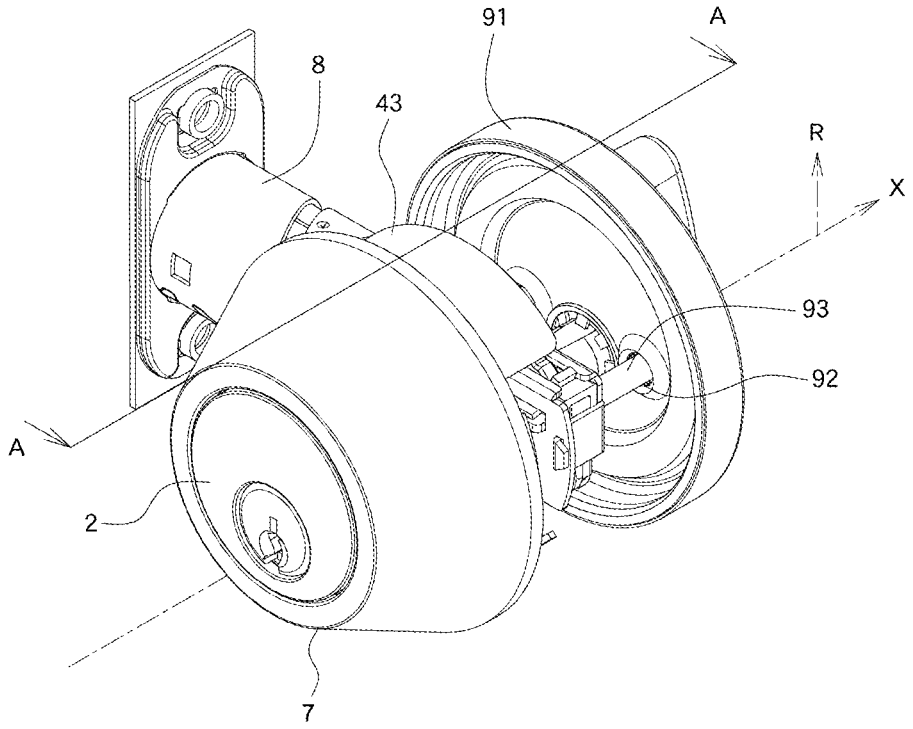
FIG. 1 is a perspective view to show the auxiliary lock of the present invention.
Figure 2:
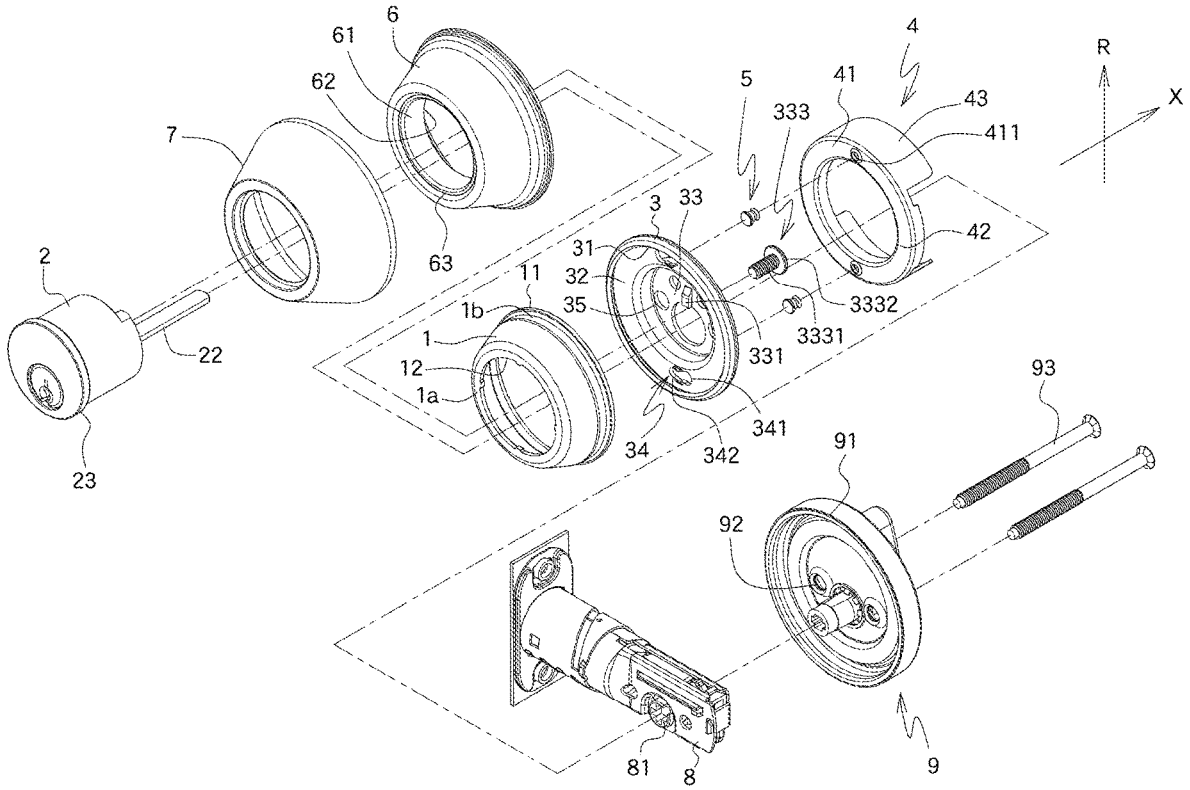
FIG. 2 is an exploded view of the auxiliary lock of the present invention.
Figure 3:
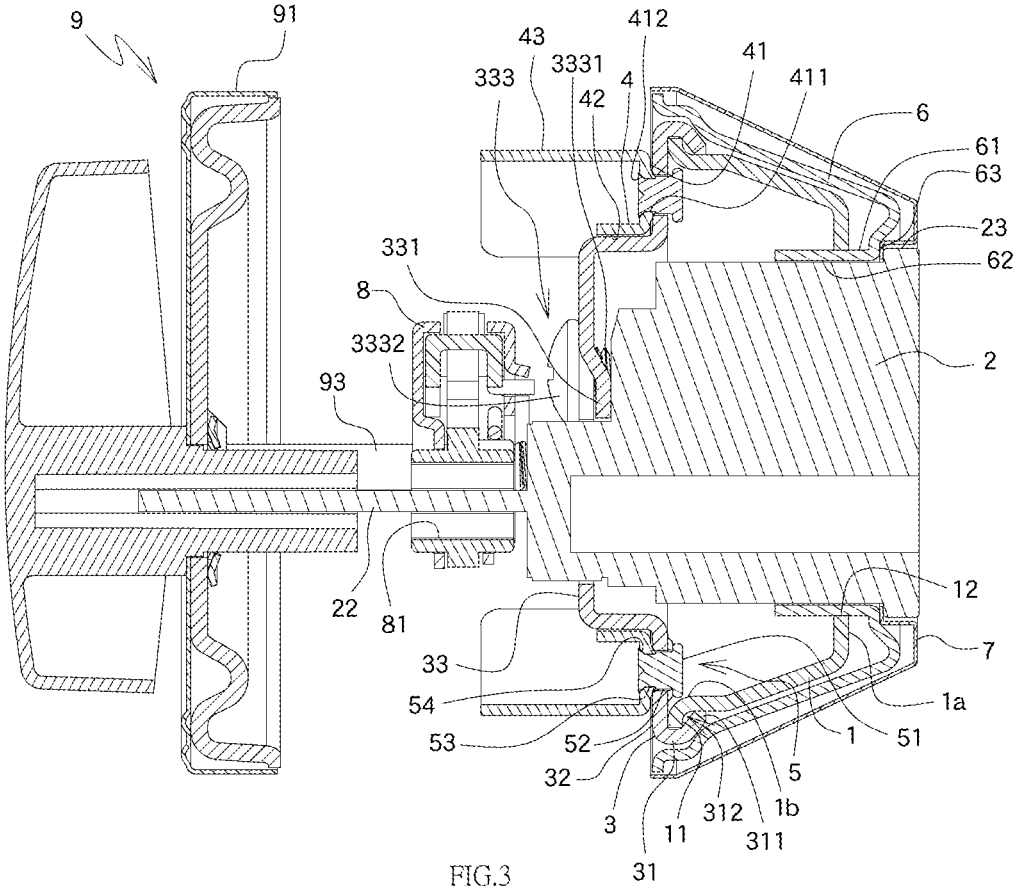
FIG. 3 is a cross sectional view, taken along line A-A in FIG. 1.

Referring to FIGS. 1 to 3, the auxiliary lock of the present invention comprises an inside housing 1 which is a tubular housing and mounted to a lock cylinder 2 in the radial direction "R" of the inside housing 1. A first flange 11 extends axially from one of two ends of the inside housing 1.

A mounting plate 3 is mounted to the lock cylinder 2 in the axial direction "X" of the lock cylinder 2 and contacts the inside housing 1. The mounting plate 3 includes a second flange 31 extending axially therefrom. The second flange 31 is mounted to the outside of the first flange 11 of the inside housing 1. The radial direction "R" and the axial direction "X" is based on the orientation of the inside housing 1 or the lock cylinder 2 so as to meet the mutual positioning relationship between the inside housing 1, the mounting plate 3 and the lock cylinder 2, but not limited thereto.

As shown in FIG. 3, the auxiliary lock is reinforced because the inside housing 1 is mounted to the lock cylinder 2, and the second flange 31 of the mounting plate 3 is mounted to the first flange 11 of the inside housing 1. Therefore, when the inside housing 1 is hit, the distal end of the inside housing 1 may be broken and pried up if no mounting plate 3 is installed. For the present invention, the second flange 31 of the mounting plate 3 is mounted to the first flange 11 of the inside housing 1 so that the distal end of the inside housing 1 is reinforced and is no pried up, such that there will be no gap is formed when the inside housing 1 is hit, and any unauthorized person cannot use a tool to insert into the gap. Due to function reason or aesthetic reason, the inside housing 1 is a tapered and tubular housing, and includes a first end 1*a* and a second end 1*b* which is larger than the first end 1*a* of the inside housing 1. When the first end 1*a* is applied by a force, because the diameter of the second end 1*b* is larger than that of the first end 1*a* of the inside housing 1, the strength of the second end 1*b* is less than that of the first end 1*a* of the inside housing 1. By the second flange 31 mounted to the first flange 11, the second end 1*a* is reinforced and is not deformed by the force. It is noted that the second flange 31 of the mounting plate 3 is mounted to the first flange 11 of the inside housing 1 during manufacturing processes, and therefore, the mounting plate 3 is no separated from the inside housing 1.

The inside housing 1 can be made by way of pressing to use less material and to reduce the manufacturing cost. In another embodiment, the inside housing 1 can also be a solid or hollow metal casting part. In this embodiment, the second flange 31 is mounted to the outside of the first flange 11 of the inside housing 1 by way of pressing. Of course, riveting can also be applied after the second flange 31 is mounted to the outside of the first flange 11 to further strengthen the connection.

It is also noted that the second flange 31 is not necessarily completely matched the outside of the first flange 11. In other words, a gap is formed between the second flange 31 and the first flange 11 is also included within the scope of the present invention. In this embodiment, the second flange 31 includes a bent portion 311 which is formed by bending inward the distal end of the second flange 31. A space 312 is formed between the bent portion 311 and the second flange 31. The first flange 11 of the inside housing 1 is located in the space 312, and the bent portion 311 is mounted to the outside of the first flange 11 of the inside housing 1.

The mounting plate 3 is designed to allow the auxiliary lock of the present invention to be installed to a door hole (not shown). The mounting plate 3 includes an annular face 32 extending therefrom and opposite to the inside housing 1. An end face 33 is formed to the distal end of the annular face 32. The end face 33 is able to be installed into the door hole when installing the auxiliary lock to a door.

The mounting plate 3 is made by way of pressing, and the end face 33 is a protruded portion which contacts the lock cylinder 2 in the axial direction "X". In this embodiment, the mounting plate 3 includes a protrusion 331 extending from the inside thereof which faces the lock cylinder 2. When the mounting plate 3 is mounted to the lock cylinder 2, the protrusion 331 contacts the lock cylinder 2 in the axial direction "X" of the lock cylinder 2 so as to avoid the end face 33 from affecting the positioning of the lock cylinder 2. The protrusion 331 can also be made during the pressing process to the mounting plate 3.

Figure 4:
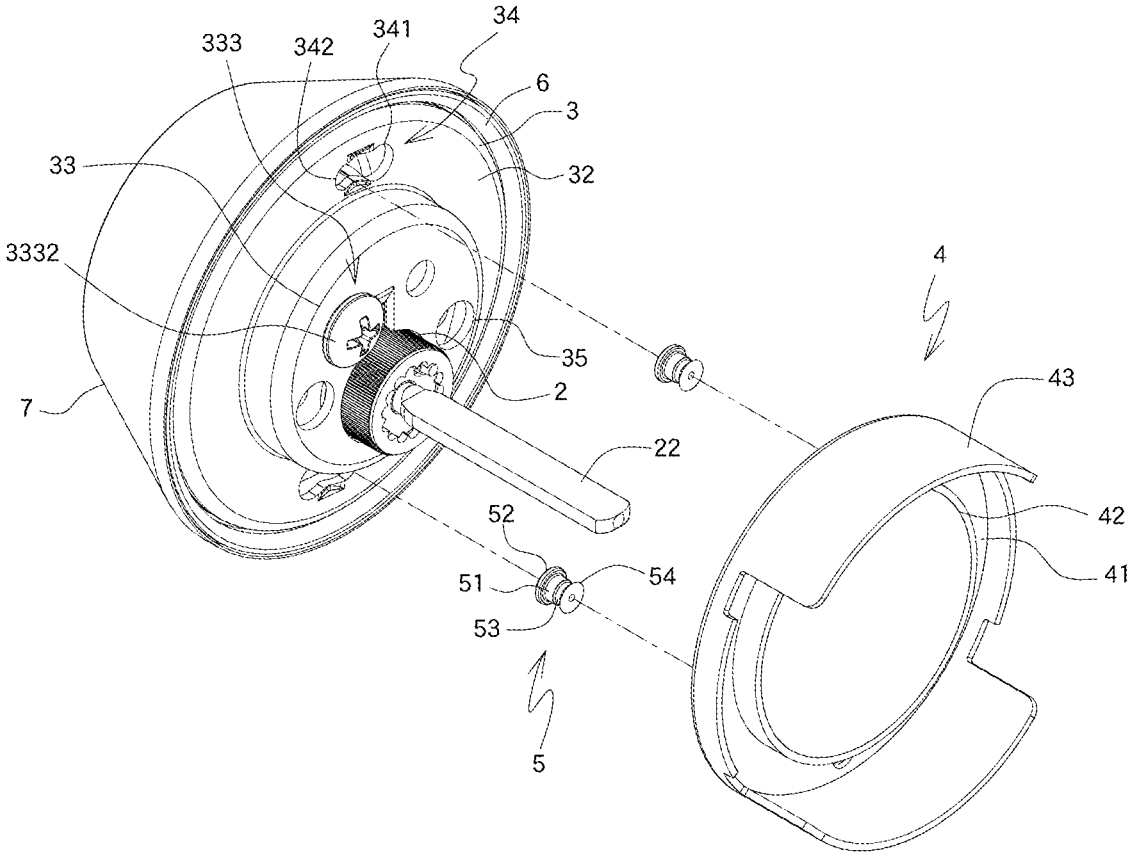
FIG. 4 shows the housing ring is to be installed to the auxiliary lock of the present invention.
Figure 5:
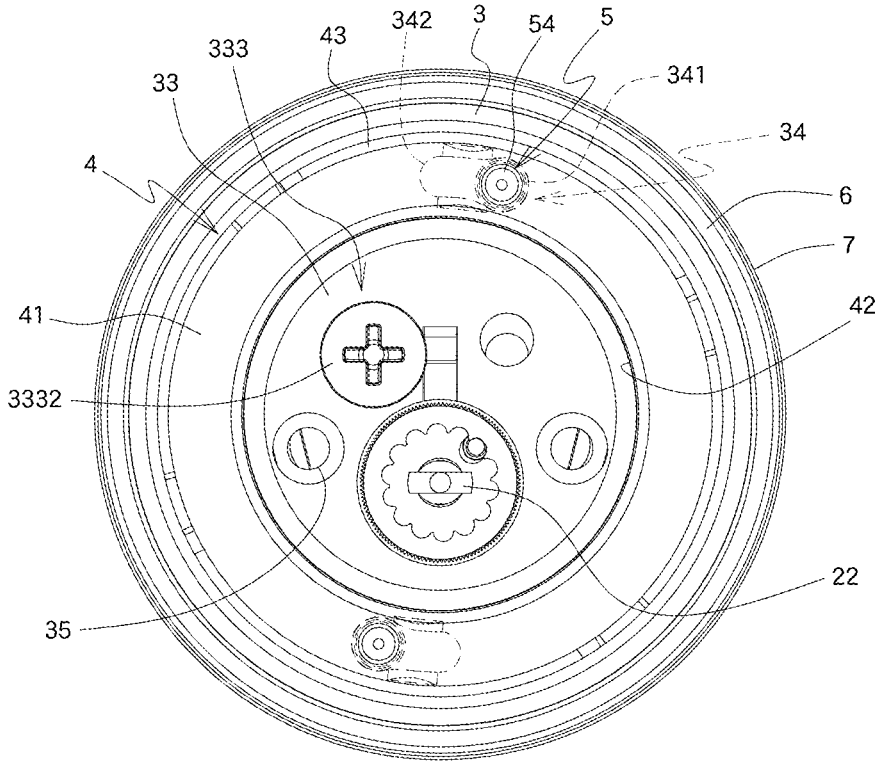
FIG. 5 shows that the housing ring where the pin is located at the first hole of the guide slot.
Figure 6:
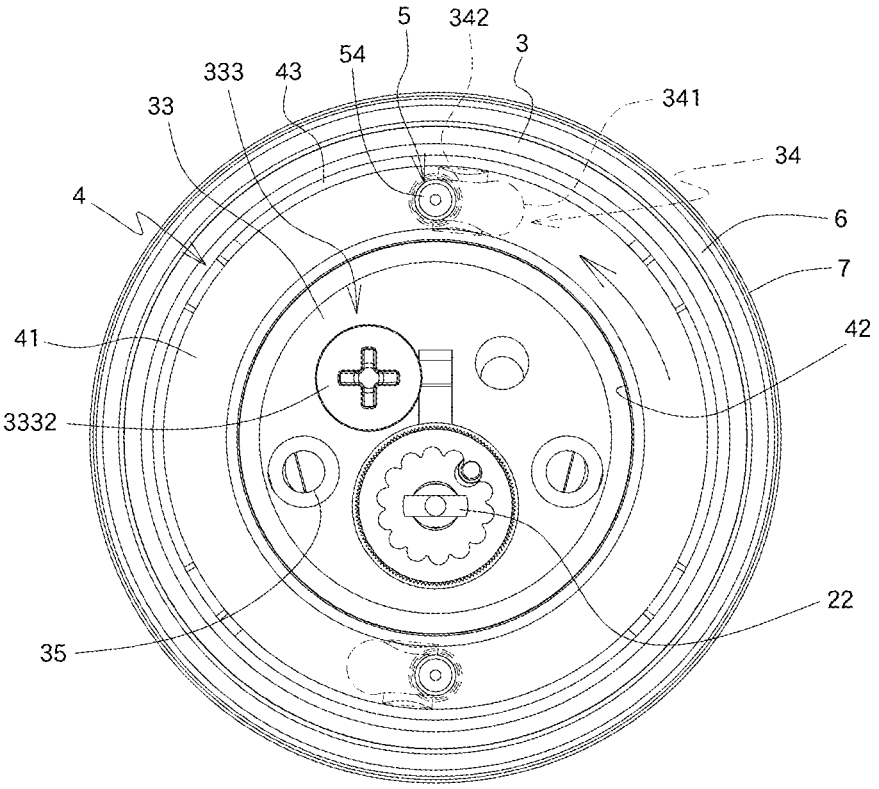
FIG. 6 shows that the housing ring is rotated to move the pin to the second hole of the guide slot.

Because the door holes of different doors may not the same, so that the annular face 32 of the mounting plate 3 may have spare holes so that when the door hole is larger than the end face 33, other parts can be installed to the mounting plate 3. In this embodiment, the end face 32 of the mounting plate 3 includes at least one guide slot 34 which includes a first hole 341 and a second hole 342 which communicates with the first hole 341. The diameter of the first hole 34 is larger than that of the second hole 342. The guide slot 34 is used to be connected with a housing ring 4. In this embodiment, the housing ring 4 includes a contact face 41 and a central hole 42. The contact face 41 is located corresponding to the annular face 32. The central hole 42 is located corresponding to the end face 33. At least one extension 43 extends axially from the housing ring 4 and opposite to the mounting plate 3. The contact face 41 include at least one pin 5 which is located corresponding to the at least one guide slot 34. The at least one pin 5 includes a shank 51 which has a contact portion 52 formed to the first end of the shank 51. The diameter of the shank 51 is sized corresponding to the second hole 342, and the diameter of the contact portion 52 is sized corresponding to the first hole 341. As shown in FIGS. 4 and 5, when installing the housing ring 4, the contact portion 52 of the pin 5 extends through the first hole 341, and the shank 51 is located in the guide slot 34. As shown in FIG. 6, the housing ring 4 is rotated in the direction from the first hole 341 toward the second hole 342, so that the shank 51 is moved to the second hole 342 and is force-fitted into the second hole 342 to position the housing ring 4 relative to the mounting plate 3. Therefore, the auxiliary lock can be installed to the large door hole by the extension 43.

The pin 5 and the housing ring 4 can be formed to be a one-piece unit. In this embodiment, the contact face 41 includes at least one assembly hole 411, and the at least one pin 5 is engaged with the at least one assembly hole 411. Specifically, the at least one assembly hole 411 communicates with an inclined hole 412 which is located opposite to the contact face 41 of the housing ring 4. The diameter of the inclined hole 412 gradually increases toward the direction opposite to the contact face 41. The shank 51 includes an engaging portion 53 and a positioning portion 54 respectively formed to the second end thereof. The engaging portion 53 is located corresponding to the least one assembly hole 411, and the positioning portion 54 is located corresponding to the inclined hole 412. The pin 5 can be made by flexible material so that the pin 5 is easily inserted into the assembly hole 411 to make the positioning portion 54 engaged with the inclined hole 412. The diameter of the inclined hole 412 gradually increases toward the direction opposite to the assembly hole 411, so that when the shank 51 of the pin 5 moves to the first hole 341, the positioning portion 54 and the contact portion 52 respectively contacts the inner periphery of the inclined hole 412 and the end face 33 to position the mounting plate 3 and the housing ring 4 in the axial direction "X". The mounting plate 3 and the housing ring 4 do not shift by a force applied to them.

Figure 7:
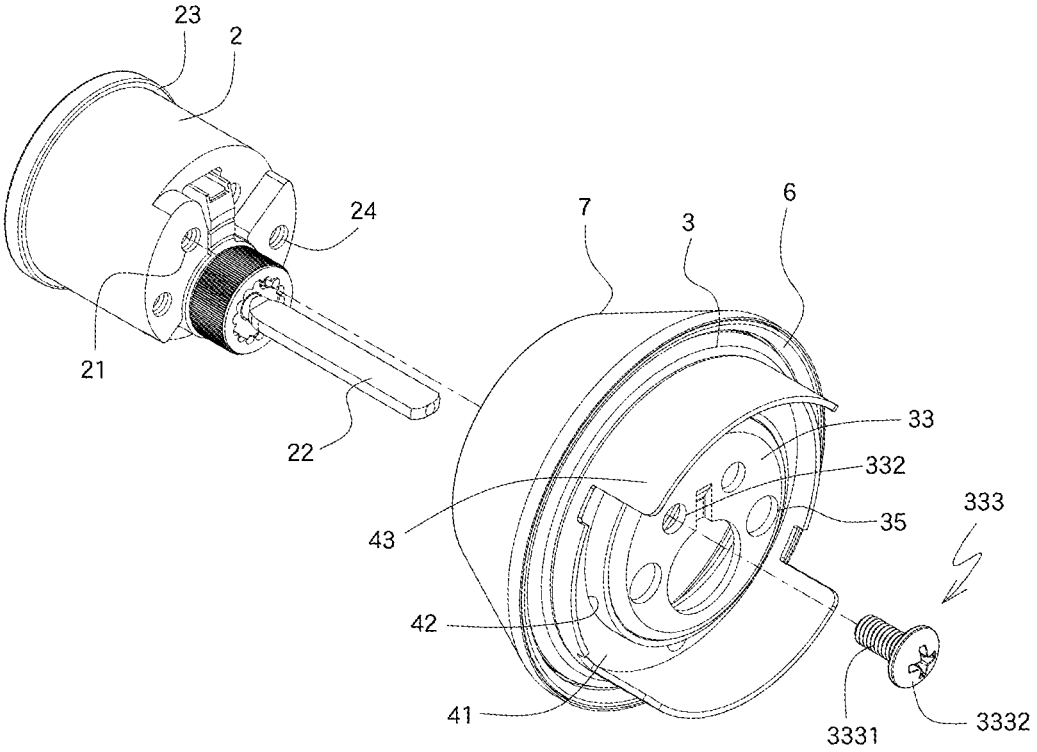
FIG. 7 shows that the lock cylinder is removed from the auxiliary lock of the present invention.
Figure 8:
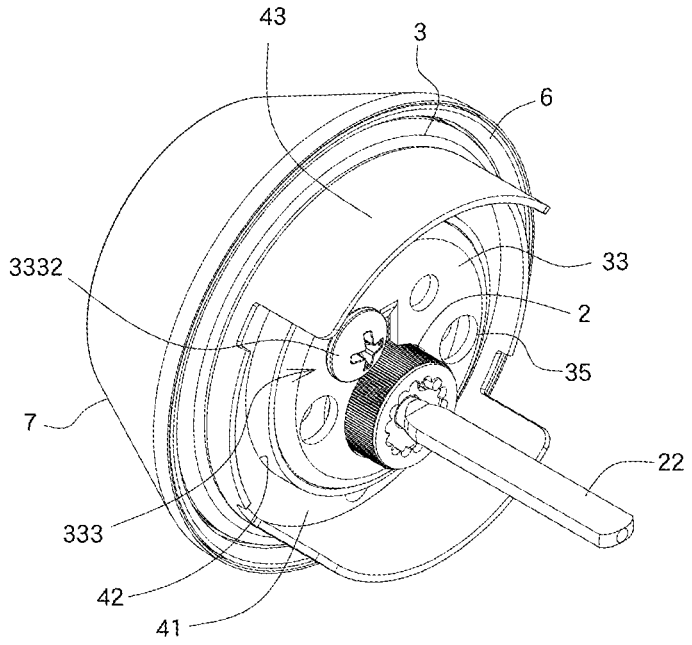
FIG. 8 shows that the lock cylinder, the decoration cover, the outside housing, the inside housing and the mounting plate are formed to a one-piece unit.

As shown in FIGS. 3, 7 and 8, the lock cylinder 2 is located in the inside housing 1, and the distal end of the lock cylinder 2 in the axial direction "X" is supported by the mounting plate 3. The lock cylinder 2 includes a first fixing hole 21. The end face 33 of the mounting plate 3 includes an aperture 332 located corresponding to the first fixing hole 21. A locking member 333 extends through the aperture 332 from the outside of the end face 33 and is connected to the first fixing hole 21 to complete the positioning between the lock cylinder 2, the mounting plate 3 and the inside housing 1. In one embodiment, the locking member 333 includes a threaded section 3331 and a head 3332. The threaded section 3331 is threadedly connected to the first fixing hole 21. The diameter of the head 3332 is larger than that of the aperture 332. When the threaded section 3331 is threadedly connected to the first fixing hole 21, the head 3332 contacts the end face 33. The first fixing hole 21 can be a threaded hole, and the locking member 333 can be a bolt. The integral unit mentioned above reinforces the strength of the auxiliary lock and well positions the lock cylinder 2. When replacing the lock cylinder 2, simply removing the locking member 333 from the first fixing hole 21, the lock cylinder 2 can be removed and replaced.

As shown in FIGS. 3, 7 and 8, an outside housing 6 is mounted to the inside housing 1 so as to protect the inside housing 1. Specifically, the inside housing 1 includes a through hole 12 located corresponding to the lock cylinder 2. The outside housing 6 includes a tubular portion 61 extending from one end opposite to the inside housing 1 and toward the inside housing 1. The tubular portion 61 has a path 62 defined centrally therethrough, and the lock cylinder 2 extends through the path 62. The outer periphery of the tubular portion 61 contacts the inner periphery of the through hole 12. In one embodiment, the tubular portion 61 and the outside housing 6 are formed by way of pressing. The tubular portion 61 contacts the inner periphery of the through hole 12 to securely assemble the outside housing 6 and the inside housing 1 so as to integrally form the inside housing 1, the mounting plate 3 and the lock cylinder 2 as a one-piece unit.

For the axially positioning of the outside housing 6 and the lock cylinder 2, the lock cylinder 2 includes a lip 23 extending radially therefrom. The outside housing 6 includes a concaved surface 63 located corresponding to the lip 23. The tubular portion 61 is located at the distal end of the concaved surface 63 so that the lock cylinder 2 is axially installed into the outside housing 6, and the lip 23 is axially in contact with the concaved surface 63. When the locking member 333 is connected between the lock cylinder 2 and the inside housing 1, the lip 23 of the lock cylinder 2 contacts the concaved surface 63 of the outside housing 6. The mounting plate 3 is located in the housing 1 so that the inside housing 1, the lock cylinder 2, the mounting plate 3 and the outside housing 6 are assembled to be a one-piece unit which is convenient for the users to install after purchasing the auxiliary lock of the present invention.

In addition, a decoration cover 7 is mounted to the outside housing 6 to have a decorated appearance and to have a protection feature to the outermost of the auxiliary lock, therefore, the lock cylinder 2 is protected from being hit.

The auxiliary lock of the present invention is cooperated with a deadbolt 8 which includes a cam slot 81. The lock cylinder 2 includes a driving bar 22 which extends through the cam slot 81 and the mounting plate 3 so that the lock cylinder 2 is locked or unlocked by the driving bar 22. The lock cylinder 2 has one of two ends thereof located at the outside of the door, and another one of the two ends of the lock cylinder 2 is located in the door. A turn piece assembly 9 is located at the inside of the door and is connected to the driving bar 22 and the deadbolt 8. The turn piece assembly 9 includes a body 91 which has at least one bore 92. The lock cylinder 2 includes a second fixing hole 24 which is located corresponding to the at least one bore 92. The mounting plate 3 includes an end hole 35 which is located corresponding to the at least one bore 92 and the second fixing hole 24. A bolt 93 extends through the at least one bore 92 and the end hole 35, and is connected to the second fixing hole 24, such that the auxiliary lock of the present invention is installed to the door and is able to lock and unlocked.

While we have shown and described the embodiment in accordance with the present invention, it should be clear to those skilled in the art that further embodiments may be made without departing from the scope of the present invention.

What is claimed is:

1. An auxiliary lock comprising:

an inside housing (1) being a tubular housing and mounted to a lock cylinder (2) in a radial direction of the inside housing (1), a first flange (11) extending axially from one of two ends of the inside housing (1), and a mounting plate (3) mounted to the lock cylinder (2) in an axial direction of the lock cylinder (2) and contacting the inside housing (1), the mounting plate (3) having a second flange (31) extending axially therefrom, the second flange (31) being mounted to an outside of the first flange (11) of the inside housing (1), wherein the second flange 31) includes a bent portion (311) which is formed by bending inward a distal end of the second flange (31), a space (312) is formed between the bent portion (311) and the second flange (31), the first flange (11) of the inside housing (1) is located in the space (312), the bent portion (311) is mounted to the outside of the first flange (11) of the inside housing (1).

2. The auxiliary lock as claimed in claim 1, wherein the second flange (31) is mounted to the outside of the first flange (11) of the inside housing (1) by way of pressing.

3. The auxiliary lock as claimed in claim 1, wherein the mounting plate (3) includes an annular face (32) extending therefrom and opposite to the inside housing (1), an end face (33) is formed to a distal end of the annular face (32).

4. The auxiliary lock as claimed in claim 3, wherein the end face (33) includes a protrusion (331) extending from an inside thereof which faces the lock cylinder (2), when the mounting plate (3) is mounted to the lock cylinder (2), the protrusion (331) contacts the lock cylinder (2) in an axial direction of the lock cylinder (2).

5. The auxiliary lock as claimed in claim 3, wherein the end face (32) of the mounting plate (3) includes at least one guide slot (34) which includes a first hole (341) and a second hole (342) which communicates with the first hole (341), a diameter of the first hole (34) is larger than that of the second hole (342).

6. The auxiliary lock as claimed in claim 5 further comprising a housing ring (4) which includes a contact face (41) and a central hole (42), the contact face (41) located corresponding to the annular face (32), the central hole (42) located corresponding to the end face (33), at least one extension (43) extending axially from the housing ring (4) and opposite to the mounting plate (3), the contact face (41) including at least one pin (5) which is located corresponding to the at least one guide slot (34), the at least one pin (5) including a shank (51) which has a contact portion (52) formed to a first end of the shank (51), a diameter of the shank (51) is sized corresponding to the second hole (342), a diameter of the contact portion (52) is sized corresponding to the first hole (341).

7. The auxiliary lock as claimed in claim 6, wherein the contact face (41) includes at least one assembly hole (411), the at least one pin (5) is engaged with the at least one assembly hole (411).

8. The auxiliary lock as claimed in claim 7, wherein the at least one assembly hole (411) communicates with an inclined hole (412) which is located opposite to the contact face (41) of the housing ring (4), a diameter of the inclined hole (412) increases toward a direction opposite to the contact face (41), the shank (51) includes an engaging portion (53) and a positioning portion (54) respectively formed to a second end thereof, the engaging portion (53) is located corresponding to the least one assembly hole (411), the positioning portion (54) is located corresponding to the inclined hole (412).

9. The auxiliary lock as claimed in claim 3, wherein the lock cylinder (2) includes a first fixing hole (21), the end face (33) of the mounting plate (3) includes an aperture (332) located corresponding to the first fixing hole (21), a locking member (333) extends through the aperture (332) from an outside of the end face (33) and is connected to the first fixing hole (21).

10. The auxiliary lock as claimed in claim 9, wherein the locking member (333) includes a threaded section (3331) and a head (3332), the threaded section (3331) is threadedly connected to the first fixing hole (21), a diameter of the head (3332) is larger than that of the aperture (332), when the threaded section (3331) is threadedly connected to the first fixing hole (21), the head (3332) contacts the end face (33).

11. The auxiliary lock as claimed in claim 1, wherein an outside housing (6) is mounted to the inside housing (1).

12. The auxiliary lock as claimed in claim 11, wherein the lock cylinder (2) includes a lip (23) extending radially therefrom, the outside housing (6) includes a concaved surface (63) located corresponding to the lip (23).

13. The auxiliary lock as claimed in claim 11, wherein the inside housing (1) includes a through hole (12) located corresponding to the lock cylinder (2), the outside housing (6) includes a tubular portion (61) extending from one end opposite to the inside housing (1) and toward the inside housing (1), the tubular portion (61) has a path (62) defined centrally therethrough, the lock cylinder (2) extends through the path (62), an outer periphery of the tubular portion (61) contacts an inner periphery of the through hole (12).

14. The auxiliary lock as claimed in claim 13, wherein the tubular portion (61) of the outside housing (6) is made by way of pressing.

15. The auxiliary lock as claimed in claim 11, wherein a decoration cover (7) is mounted to the outside housing (6).

16. The auxiliary lock as claimed in claim 1, wherein the inside housing (1) is a tapered and tubular housing.

17. An auxiliary lock comprising:

an inside housing (1) being a tapered and tubular housing and including a first end (1*a*) and a second end (1*b*) which is larger than the first end (1*a*) of the inside housing (1), a first flange (11) extending axially from the second end (1*b*) of the inside housing (1), and a mounting plate (3) mounted to the lock cylinder (2) in an axial direction of the mounting plate (3) and contacting the inside housing (1), the mounting plate (3) having a second flange (31) extending axially therefrom, the second flange (31) being mounted to an outside of the first flange (11) of the inside housing (1), wherein the second flange (31) includes a bent portion (311) which is formed by bending inward a distal end of the second flange (31), a space (312) is formed between the bent portion (311) and the second flange (31), the first flange (11) of the inside housing (1) is located in the space (312), the bent portion (311) is mounted to the outside of the first flange (11) of the inside housing (1).

18. The auxiliary lock as claimed in claim 17, wherein the second flange (31) is mounted to the outside of the first flange (11) of the inside housing (1) by way of pressing.

19. An auxiliary lock comprising:

an inside housing (1) being a tubular housing and mounted to a lock cylinder (2) in a radial direction of the inside housing (1), a first flange (11) extending axially from one of two ends of the inside housing (1), and a mounting plate (3) mounted to the lock cylinder (2) in an axial direction of the lock cylinder (2) and contacting the inside housing (1), the mounting plate (3) having a second flange (31) extending axially therefrom, the second flange (31) being mounted to an outside of the first flange (11) of the inside housing (1), wherein the mounting plate (3) includes an annular face (32) extending therefrom and opposite to the inside housing (1), wherein an end face (33) is formed to a distal end of the annular face (32), the end face (33) including a protrusion (331) extending from an inside of the end face (33) which faces the lock cylinder (2), and wherein, when the mounting plate (3) is mounted to the lock cylinder (2), the protrusion (331) contacts the lock cylinder (2) in an axial direction of the lock cylinder (2).

* * * * *